United States Patent [19]

Warner

[11] 4,449,356

[45] May 22, 1984

[54] CONTINUOUS A.C. TENSION CONTROL

[75] Inventor: Charles E. Warner, Spartanburg, S.C.

[73] Assignee: Milliken Research Corporation, Spartanburg, S.C.

[21] Appl. No.: 440,498

[22] Filed: Nov. 10, 1982

[51] Int. Cl.[3] ..... D01H 7/18; D02G 3/34; D02H 13/22; B65H 59/22

[52] U.S. Cl. ..... 57/284; 57/91; 57/283; 57/354; 242/150 M; 242/131

[58] Field of Search ..... 57/58.59, 58.7, 58.72, 57/58.83, 58.86, 90–94, 100, 127.5, 127.7, 206, 208, 264, 282, 283, 284, 351, 352, 354; 242/150 M, 131, 131.1

[56] References Cited

U.S. PATENT DOCUMENTS

| | | | |
|---|---|---|---|
| 2,624,527 | 1/1953 | Von Kohorn | 242/155 |
| 2,705,362 | 4/1955 | Roughsedge | 28/51 |
| 2,724,065 | 11/1955 | Saxl | 310/93 |
| 2,931,090 | 4/1960 | Field, Jr. | 28/1 |
| 2,946,177 | 7/1960 | Scragg et al. | 57/284 |
| 2,978,203 | 4/1961 | Westall et al. | 242/155 |
| 2,999,351 | 9/1961 | Davenport et al. | 57/140 |
| 3,011,736 | 12/1961 | Furst et al. | 57/352 X |
| 3,016,681 | 1/1962 | Andremont | 57/354 X |
| 3,022,025 | 2/1962 | Saxl | 242/155 |
| 3,047,932 | 8/1962 | Pittman et al. | 28/1 |
| 3,053,474 | 9/1962 | Luntz et al. | 242/150 M |
| 3,095,630 | 7/1963 | Pittman | 28/1 |
| 3,100,091 | 8/1963 | Mindheim et al. | 242/150 M |
| 3,106,442 | 10/1963 | Compostella et al. | 18/48 |
| 3,112,600 | 12/1963 | Stoddard et al. | 57/34 |
| 3,113,746 | 12/1963 | Steen | 242/155 |
| 3,152,436 | 10/1964 | Dudzik et al. | 57/157 |
| 3,194,000 | 7/1965 | Eldridge et al. | 57/34 |
| 3,352,511 | 11/1967 | Wiggins | 242/155 |
| 3,438,194 | 4/1969 | Cerutti et al. | 57/157 |
| 3,457,716 | 7/1969 | Eldridge et al. | 57/6 |
| 3,606,196 | 9/1971 | Heard | 242/155 M |
| 3,724,409 | 4/1973 | Olney, Jr. | 112/255 |
| 3,782,091 | 1/1974 | Spurgeon | 57/34 HS |
| 3,797,775 | 3/1974 | White | 242/155 M |
| 3,831,880 | 8/1974 | White et al. | 242/156 |
| 3,897,916 | 8/1975 | Rosen | 242/155 M |
| 4,035,879 | 7/1977 | Schippers | 28/246 |
| 4,112,561 | 9/1978 | Norris et al. | 57/91 X |
| 4,186,896 | 2/1980 | Brandenberger et al. | 242/131 |
| 4,313,578 | 2/1982 | Wilson et al. | 242/150 M |

*Primary Examiner*—Donald Watkins

*Attorney, Agent, or Firm*—Earle R. Marden; H. William Petry

[57] ABSTRACT

A direct current electromagnetic disc type tension control which has alternating current superimposed on the direct current circuit to allow the electromagnet to vibrate the tension discs in order to break the contact between the tension discs to lower the resistance to rotation of the discs by the yarn passing therethrough. The direct current circuit includes a source of high voltage and a source of low voltage and the current from the low direct current voltage source is cut off periodically and momentarily.

11 Claims, 10 Drawing Figures

CONTINUOUS A.C. TENSION CONTROL

This invention relates generally to the employment of an electromagnetically actuated disc tension control to intermittently grasp and release a continuous filament synthetic yarn which is being processed downstream of the tension control.

It is an object of the invention to provide a yarn processing system which employs a disc tension control to randomly vary the tension of a yarn being processed in a yarn processing machine.

Other objects and advantages of the invention will become readily apparent as the specification proceeds to describe the invention with reference to the accompanying drawings, in which.

Figure 1:
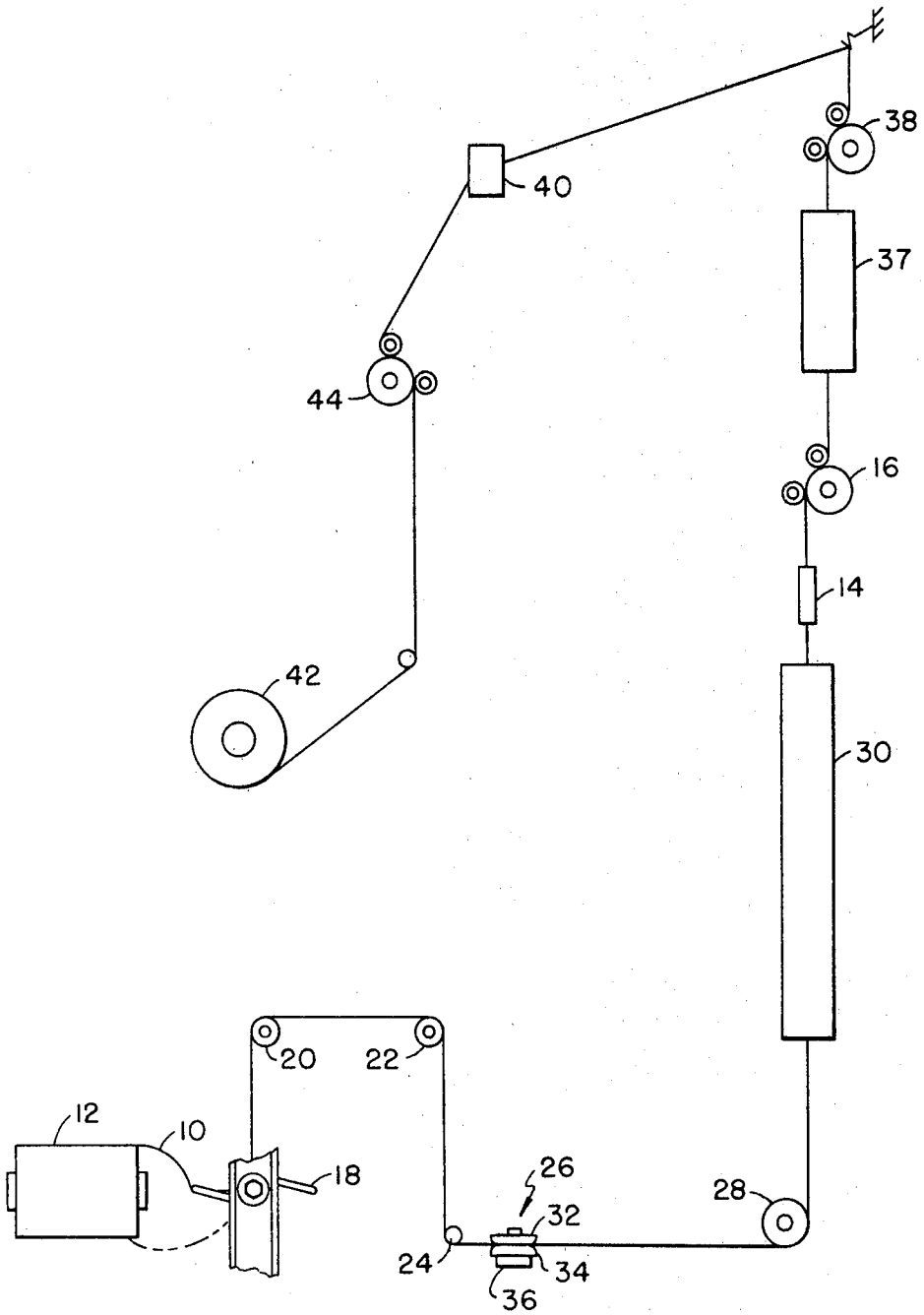
FIG. 1 is an overall schematic representation of the new and novel system to produce a textured, continuous filament synthetic yarn.

Looking now to FIG. 1, the overall system of FIG. 1 will be explained to obtain the novel disclosed yarn. The system is directed to a method to produce a specially textured yarn by intermittently varying the draw of a continuous filament partially oriented, synthetic, multifilament yarn such as polyester. The multifilament yarn 10 is supplied from a supply package 12 to the false twist device 14 by the feed roll device 16. The yarn 10 from the package 12 successively, in its travel to the feed roll device 16, passes through the balloon control apparatus 18, over the guide members 20, 22 and 24 through the electro-magnetically controlled tension disc apparatus 26 and under the guide member 28 through the primary heater 30 and false twist device 14 to the feed roll device 16. The yarn 10 is intermittently and randomly drawn in the primary heater 30 by the intermittent hold back action of the disc tension apparatus 26. The discs 32 and 34 are intermittently and randomly drawn together and released on the yarn 10 by the action of the electromagnet 36 controlled by the varying voltage supplied thereto by a suitable voltage source which is varied by the action of a random signal generator.

From the feed roll device 16 the textured yarn passes through the secondary heater 37 with very little overfeed since the speed of the feed roll device 38 is substantially the same as the feed roll device 16 and the crimp in the yarn is allowed to set. Depending on the amount of crimp contraction desired the secondary heater can be turned on at an appropriate temperature or off or by-passed and the overfeed varied from high to very little.

The feed roll device 38 is driven at a higher speed than the feed roll device 44 to overfeed the textured yarn through the air jet entangling device 40 to commingle and entangle the individual filaments of the textured yarn. From the feed roll device 38 the entangled, textured yarn is slightly overfed to the yarn take-up package 42 by the feed roll device 44.

Figure 2:
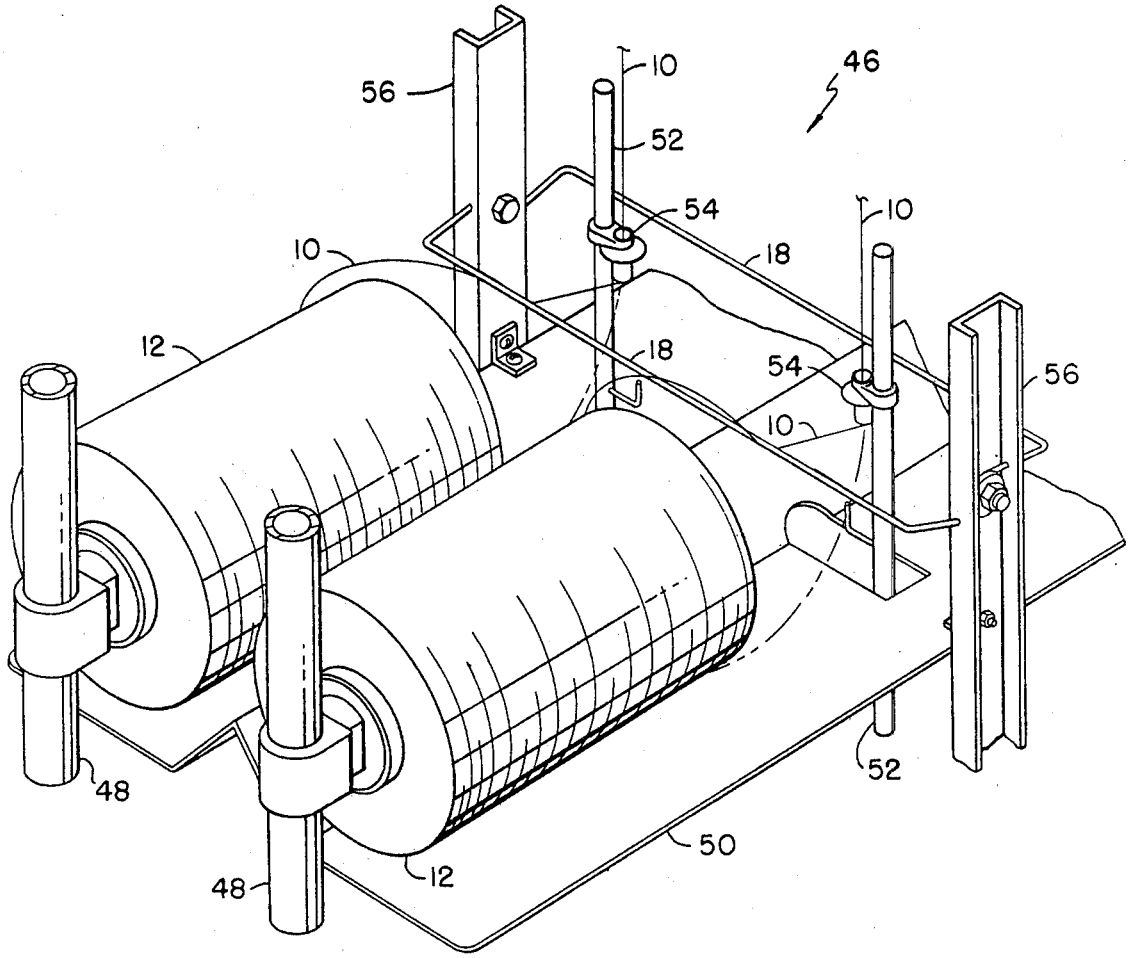
FIG. 2 is a partial perspective view of the yarn supply creel for the system shown in FIG. 1.

Schematically in FIG. 1, the yarn package 12 and the balloon control element 18 are shown as separate items but in actual practice a creel unit, designated 46 in FIG. 2, is used. The creel unit 46 supports a plurality of packages 12 for a plurality of false twist spindle positions and is slid in and out of position relative to a multiple spindle false twisting machine. In FIG. 2 a partial creel is shown supporting a pair of supply packages held on creel pins supported by creel pin support members 48 that are connected to the creel. Also connected to the creel is a horizontal separation plate 50 through which the yarn guide supports 52 project. A yarn guide 54 for each yarn package is connected thereto to guide the yarn 10 from the package 12 towards the guide member 20. Mounted on both sides of the horizontal separator plate 50 is a channel beam 56 between which is connected the balloon control apparatus or bar 18. The balloon of yarn from the creel is unusually erratic and violent due to the alternating take-off velocity and is therefore prone to entanglement if not controlled. As shown in FIG. 2 the bar 18 prevents yarn 10 from the package 12 from forming a full balloon and getting entangled in and around various elements of the creel such as yarn guides 54. As shown in FIG. 2, a second bar 18 is shown which is used for the same purpose for the yarn packages (not shown) on the opposite side of the creel unit 46.

Figure 3:
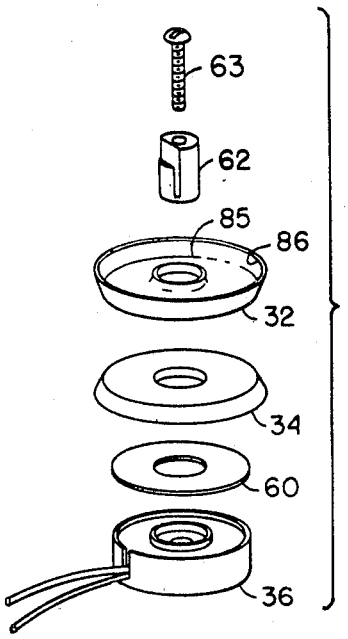
FIG. 3 is an exploded schematic view of the yarn tension disc device used in the system of FIG. 1.
Figure 4:
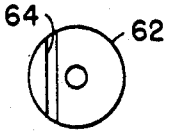
FIG. 4 is a top view of the post of the yarn tension disc device of FIG. 3.
Figure 5:
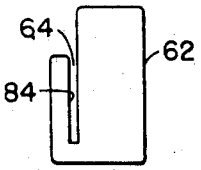
FIG. 5 is a side elevation view of the post shown in FIG. 4.
Figure 6:
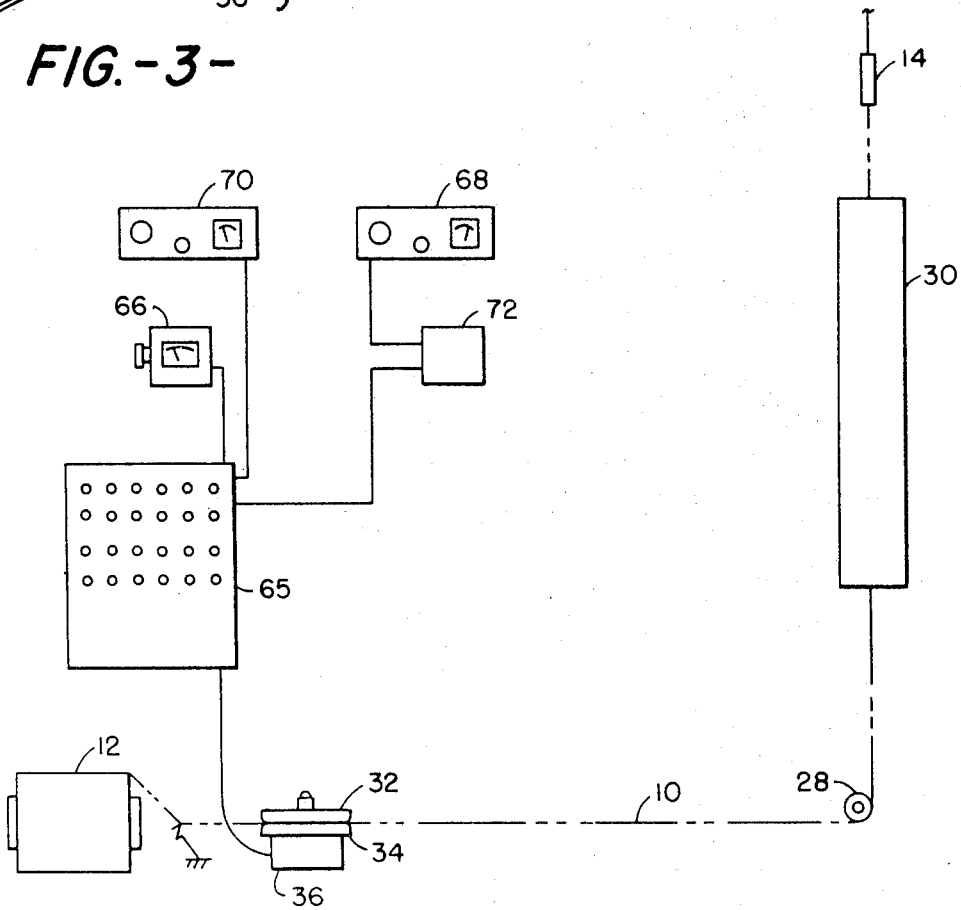
FIG. 6 is a schematic representation of the voltage control scheme for the yarn tension disc electromagnet.
Figure 7:
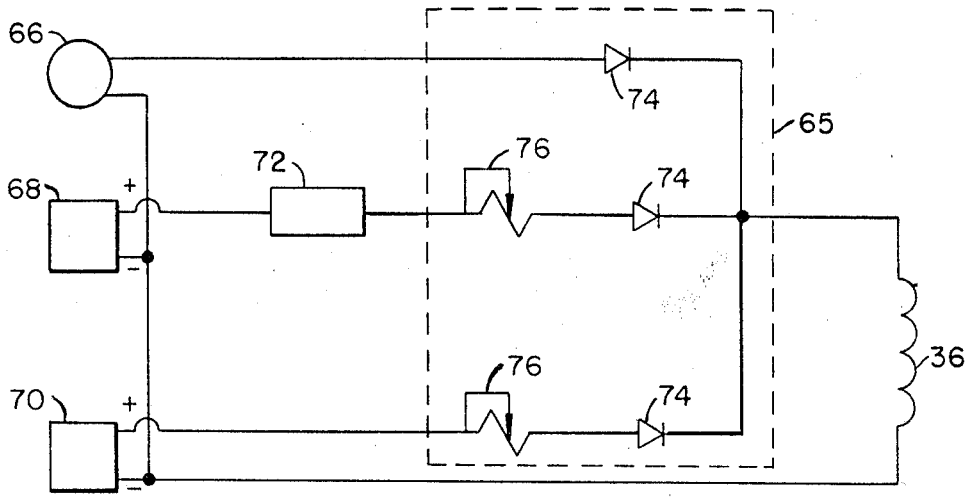
FIG. 7 is a circuit diagram for the electromagnet of the yarn tension disc device.

FIGS. 3–5 show the electromagnetically controlled tension disc apparatus 26 in detail. The apparatus 26 basically consists of the electromagnet 36, the spring biasing member 60 of Teflon or other suitable material, the tension discs 32 and 34, the disc post 62 and the screw 63 to maintain the aforementioned element in operative relationship. The disc 32 is made from a magnetically attractable material such as a ferrous material while the disc 34 is manufactured from a non-magnetically attractable material. For reasons hereafter explained the post 62 has a slot 64 therein which is off set from the centerline of the post. Also for reasons hereinafter explained, it is desired to supply random, intermittent pulses of low and high D.C. voltage with a superimposed A.C. voltage to cause the discs 32 and 34 to close randomly and intermittently and to cause the discs to vibrate relative to one another and relative to the electromagnet 36. To accomplish this action the arrangement shown in FIG. 6 and the circuit shown in FIG. 7 are employed. Basically, the voltage to the electromagnet 36 is supplied from a control box 65 which receives voltage from an A.C. power supply 66, a high voltage D.C. power supply 68 and a low voltage D.C. power supply 70. Connected between the high voltage D.C. source 68 and the control box 65 is a random signal generator 72 of the type disclosed in U.S. Pat. No. 4,160,359 which intermittently and randomly interrupts the voltage from the high voltage D.C. source to the control box 65. Located in each circuit to the electromagnet 36 is a diode 74 which only allows current to flow in one direction towards the electromagnet 36. Schematically represented in the high and low voltage D.C. circuit is an adjust switch or variable resistor 76 to adjust the D.C. voltage in the respective circuit.

Figure 8:
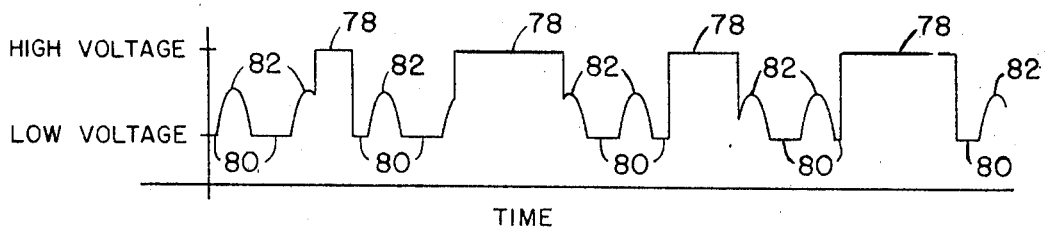
FIG. 8 is a graphical representation of the voltage supplied to the electromagnet of the yarn tension disc device.

As represented in the graph of FIG. 8, the A.C. voltage from the source 66 supplies A.C. voltage continuously while the high D.C. voltage from the source 68 is interrupted randomly and continuously by the random signal generator 72. As indicated in the graph, this provides periods of high voltage 78 and low voltage 80 for different durations of time, as well as peaks 82 at times when the high voltage D.C. current is not being supplied the and A.C. current is at its positive peak on its cycle. The various lengths of the high voltage peak 78 represent periods when the yarn 10 is being held tightly between the discs 32 and 34 while the peaks 82 and the low voltage periods 80 represent periods when the voltage is low and the discs 32 and 34 tend to release the grip on the yarn 10 and vibrate as the yarn passes therethrough. At these times the spring biasing member 60 causes the discs to be urged upward and allows the frictional resistance between the discs 32 and 34 and between the disc 34 and the electromagnet 36 to be reduced so that the torque exerted by the yarn passing through the slot 64 of the post 62 will cause them to rotate more efficiently to provide the self-cleaning action. The vibration of the discs allows the discs to be rotated more easily so that the yarn passing through will subsequently clean out the finish deposited between the discs by the yarn.

Figure 9:
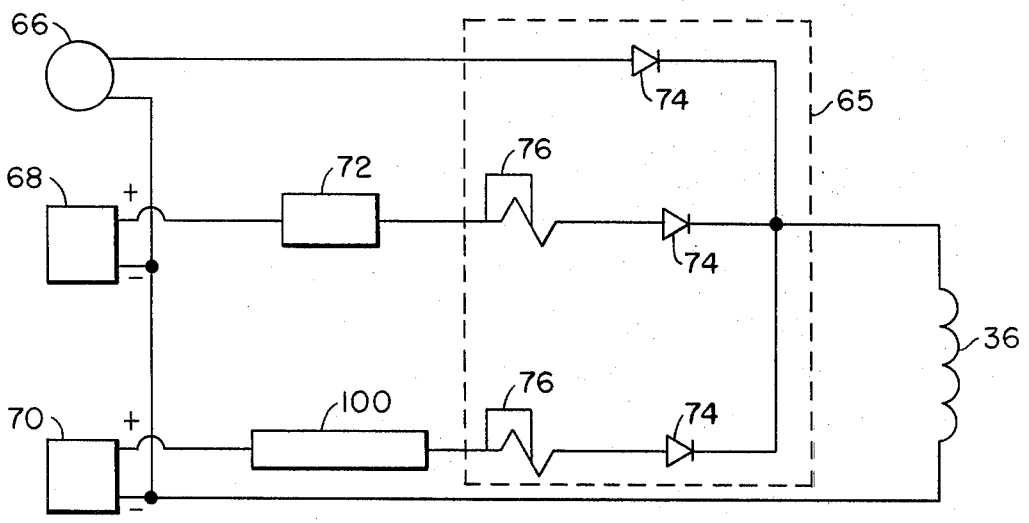
FIGS. 9 and 10 represent a modification of the invention as shown in FIGS. 7 and 8, respectively.
Figure 10:
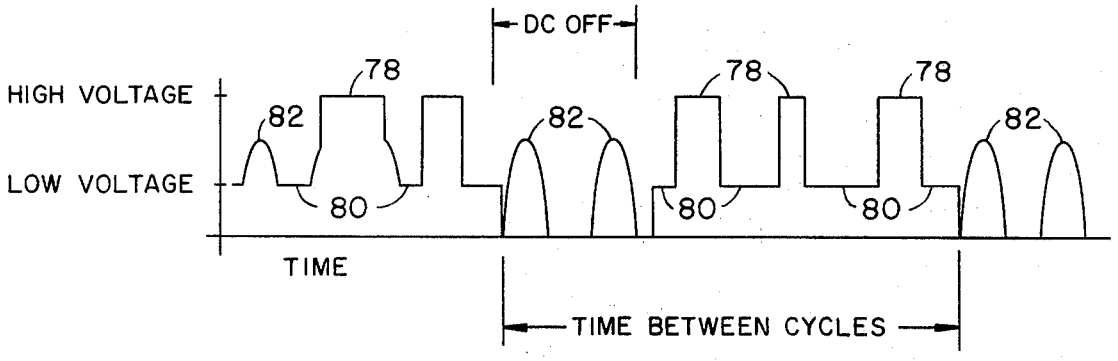

Looking now to FIGS. 9 and 10 an alternate scheme is shown to enhance the rotation of the discs 32 and 34. In FIGS. 9 and 10, elements therein which are the same in FIGS. 1–8 are indicated by the same reference number. The basic modification shown in FIGS. 9 and 10 is the inclusion of a timer 100 in the low voltage D.C. circuit to momentarily cut-off the current flow in the D.C. circuit to the electromagnet 36 to allow the A.C. voltage to peak as indicated in FIG. 10. It is understood that the current in the A.C. circuit is flowing continuously in order to obtain the result shown in FIG. 10. During periods when the timer 100 has the low voltage D.C. circuit open and the random signal generator 72 has the high voltage D.C. circuit open, only half-wave rectified A.C. voltage is applied to the coil as shown in FIG. 10. This will momentarily upset the tension of the yarn, but enhances the rotation of the discs 32 and 34.

Alternatively, the wall 84 defining one portion of the slot 64 can be eliminated and replaced by an upstanding guide member, not shown, which will serve to confine the yarn path to a path offset from the centerline of the post 62.

In the preferred form of the invention the spring biasing member 60 is of a diameter greater than the inner, internal diameter 85 and less than the inner, external diameter 86 of the lower tension disc 34 so that it is curved downward at its extremities when the discs 32 and 34 are pulled towards the electromagnet 36. Conversely, when the voltage to the electromagnet is reduced, the upward force exerted due to the bias of the member 60 urges the discs upward.

As described briefly before, it is desired to cause the tension discs 32 and 34 to rotate in order to dissipate the finish deposited therebetween by the yarn 10. As described above, the discs 32 and 34 are free to rotate on the post 62. To further enhance this rotation, the slot 64 is located off center of the centerline of the post so that the yarn passing between the discs 32 and 34 will exert a torque thereon. Furthermore, since yarn 10 is located in the slot 64 between the discs 32 and 34, the yarn cannot jump out from between the discs and have to be rethreaded. Further, such location of the yarn in the slot prevents uncontrolled texturing and lessens the tendency for yarn breaks.

In the form described hereinabove the preparation of a single end of multifilament synthetic yarn is described but, depending on the ultimate use of the yarn produced, a plurality of yarns can be interlaced or commingled in the air jet 40. Examples of such yarn are set forth below.

EXAMPLE 1

Two ends of a 240 denier, 68 filament DuPont 56T polyester yarn were processed as described above and entangled or interlaced in the air jet 40 to provide a 12/150/68 yarn with an actual denier of 321. The elongation was 51% with a crimp contraction of 1%. The operating conditions were as follows:

| | |
|---|---|
| False Twist Spindle Speed | 96000 RPM |
| Yarn Speed through Spindle | 117 yards/minute |
| False Twist | 23 turns/inch |
| Twist Multiple | 306 |
| Direction | "S" |
| Yarn Overfeed Through Heater 37 | By-passed |
| Yarn Overfeed Through Air Jet | 4.0% |
| Yarn Overfeed to Take-up | 1.7% |
| Temperature of Heater 30 | 180° C. |
| Temperature of Heater 37 | Off |
| High Pre-Spindle Tension Average | 50 grams |
| Low Pre-Spindle Tension Average | 12 grams |

The yarn thus produced has a very low crimp contraction with high luster and intermittent character.

EXAMPLE 2

Two ends of a 220 denier, 54 filament DuPont 693T polyester yarn were processed and entangled in the air jet 40 to provide a 2/150/54 yarns with an actual diameter of 328 denier. The elongation was 48% with a crimp contraction of 1.8%. The operating conditions were as follows:

| | |
|---|---|
| False Twist Spindle Speed | 129000 RPM |
| Yarn Speed through Spindle | 128 yards/minute |
| False Twist | 28 turns/inch |
| Twist Multiple | 359 |
| Direction | "S" |
| Yarn Overfeed through Heater 37 | 0 |
| Yarn Overfeed through Air Jet | 4.0% |
| Yarn Overfeed to Take-up | 1.7% |
| Temperature of Heater 30 | 180° C. |
| Temperature of Heater 37 | 190° C. |
| High Pre-Spindle Tension Average | 50 grams |
| Low Pre-Spindle Tension Average | 16 grams |

The yarn produced has a low crimp contraction with very high luster and intermittent character.

It can readily be seen that the described apparatus and method provides a randomly, intermittently textured, continuous multifilament synthetic yarn which along its length has variable molecular orientation, bulk, torque, twist and shrinkage. The produced yarn has a low crimp contraction and a high luster. This yarn is especially useful in the fabrication of a velvet-type upholstery fabric and provides unique visual effects due to its variable dye affinity.

Although the preferred embodiment of the invention has been described, it is contemplated that many changes may be made without departing from the scope or spirit of the invention and it is desired that the invention be only limited by the scope of the claims.

I claim:

1. An electromagnetically actuated tension device comprising: an electromagnet, a post member operably associated with said electromagnet, a first metallic disc member mounted on said post, a second metallic disc member mounted on said post adjacent said first disc member, a D.C. circuit supplying D.C. voltage to said electromagnet, means continuously supplying alternating current to said electromagnet and means in said D.C. circuit to periodically and momentarily interrupt the flow of direct current to said electromagnet to periodically allow said first and second disc members to move suddenly relative to one another and relative to said electromagnet.

2. The tension device of claim 1 wherein said D.C. circuit includes a high voltage source and a low voltage source and a means to periodically interrupt the high voltage source.

3. The tension device of claim 2 wherein said A.C. voltage is intermediate of the high and low D.C. voltage.

4. Apparatus to produce a yarn having areas of differential bulk throughout its length comprising: a texturing device, supplying means supplying continuous filament, synthetic yarn to said texturing device, a heater means located between said texturing device and said supply means to heat the yarn passing to said texturing device, means taking up yarn from said texturing device and a disc tension device mounted between said supply means and said heater means to vary the supply of yarn to said heater means, said disc tension including an electromagnet, a post member operably associated with said electromagnet, a first metallic disc member mounted on said post, a second metallic disc member mounted on said post adjacent said first disc member, a D.C. circuit supplying direct current to said electromagnet, means continuously supplying alternating current to said electromagnet and means in said D.C. circuit to periodically and momentarily cut off the flow of current therefrom to said electromagnet to periodically allow said first and second disc members to move suddenly relative to one another and relative to said electromagnet.

5. The apparatus of claim 4 wherein said D.C. circuit includes a high voltage source and a low voltage source and a means to periodically interrupt the high voltage source.

6. The apparatus of claim 5 wherein said A.C. voltage is intermediate of the high and low D.C. voltages.

7. The method of causing the discs of an electromagnetically actuated tension device to vibrate comprising the steps of: supplying a high direct current to the coil of the tension device, supplying a low direct current to the coil of the tension device, continuously supplying an alternating current to the coil of the tension device, periodically cutting off the high direct current to the coil of the tension device to allow the alternating current to override the low direct current, and momentarily cutting off the flow of direct current to said electromagnet.

8. The method of claim 7 wherein the high direct current is cut-off randomly and intermittently.

9. A method to produce a textured, continuous filament, synthetic yarn comprising the steps of supplying a continuous filament, synthetic yarn from a supply package through an electromagnetically actuated disc tension device and a heater to a texturing device, randomly and intermittently causing the discs of the tension device to vibrate by supplying a high direct current to the coil of the tension device, supplying a low direct current to the coil of the tension device, continuously supplying an alternating current to the coil of the tension device, periodically and momentarily cutting off the flow of the low direct current to said coil, texturing the yarn in the texturing device and taking up the textured yarn.

10. The method of claim 9 wherein the high direct current is cut-off randomly and intermittently.

11. The method of claim 10 wherein the yarn is false twisted.

* * * * *

UNITED STATES PATENT AND TRADEMARK OFFICE

CERTIFICATE OF CORRECTION

PATENT NO. : 4,449,356

DATED : May 22, 1984

INVENTOR(S) : Charles E. Warner

It is certified that error appears in the above-identified patent and that said Letters Patent is hereby corrected as shown below:

Column 4, line 14, "12/150/68" should be "2/150/68".

Signed and Sealed this

*Twenty-sixth* Day of *March 1985*

[SEAL]

*Attest:*

DONALD J. QUIGG

*Attesting Officer* *Acting Commissioner of Patents and Trademarks*